US011271305B2

(12) United States Patent
Li et al.

(10) Patent No.: US 11,271,305 B2
(45) Date of Patent: Mar. 8, 2022

(54) WIDEBAND RADIATING ELEMENTS INCLUDING PARASITIC ELEMENTS AND RELATED BASE STATION ANTENNAS

(71) Applicant: CommScope Technologies LLC, Hickory, NC (US)

(72) Inventors: Yunzhe Li, Suzhou (CN); YueMin Li, Suzhou (CN); Peter J. Bisiules, LaGrange Park, IL (US)

(73) Assignee: CommScope Technologies LLC, Hickory, NC (US)

( * ) Notice: Subject to any disclaimer, the term of this patent is extended or adjusted under 35 U.S.C. 154(b) by 18 days.

(21) Appl. No.: 16/861,427

(22) Filed: Apr. 29, 2020

(65) Prior Publication Data

US 2020/0373671 A1 Nov. 26, 2020

Related U.S. Application Data

(60) Provisional application No. 62/850,040, filed on May 20, 2019.

(51) Int. Cl.

| | |
|---|---|
| ***H01Q 5/385*** | (2015.01) |
| ***H01Q 1/24*** | (2006.01) |
| ***H01Q 1/12*** | (2006.01) |
| ***H01Q 21/06*** | (2006.01) |
| ***H01Q 19/10*** | (2006.01) |

(52) U.S. Cl.

CPC ..... *H01Q 5/385* (2015.01); *H01Q 1/1228* (2013.01); *H01Q 1/246* (2013.01); *H01Q 19/108* (2013.01); *H01Q 21/062* (2013.01)

(58) Field of Classification Search

CPC ..... H01Q 1/246; H01Q 5/385; H01Q 5/48; H01Q 9/26; H01Q 19/108; H01Q 21/062

See application file for complete search history.

(56) References Cited

U.S. PATENT DOCUMENTS

| | | | | |
|---|---|---|---|---|
| 2007/0241983 | A1* | 10/2007 | Cao | H01Q 21/26 343/797 |
| 2016/0134026 | A1* | 5/2016 | Tang | H01Q 1/246 343/797 |
| 2016/0365645 | A1* | 12/2016 | Bisiules | H01Q 21/062 |
| 2017/0264021 | A1* | 9/2017 | Heyde | H01Q 1/246 |
| 2021/0175639 | A1* | 6/2021 | Wang | H01Q 21/24 |

FOREIGN PATENT DOCUMENTS

| | | |
|---|---|---|
| CN | 206259489 U | 6/2017 |

* cited by examiner

*Primary Examiner* — Andrea Lindgren Baltzell
*Assistant Examiner* — Amal Patel
(74) *Attorney, Agent, or Firm* — Myers Bigel, P.A.

(57) ABSTRACT

A radiating element for a base station antenna includes a first dipole radiator that has a first dipole arm that has a front surface and first and second extensions that project rearwardly from respective side edges of the front surface of the first dipole arm; a second dipole radiator that has a second dipole arm that has a front surface and first and second extensions that project rearwardly from respective side edges of the front surface of the second dipole arm; and a parasitic element having a first conductive segment that is configured to capacitively couple to the first extension of the first dipole arm, a second conductive segment that is configured to capacitively couple to the second extension of the second dipole arm, and a third conductive segment that electrically connects the first conductive segment to the second conductive segment.

21 Claims, 13 Drawing Sheets

WIDEBAND RADIATING ELEMENTS INCLUDING PARASITIC ELEMENTS AND RELATED BASE STATION ANTENNAS

CROSS-REFERENCE TO RELATED APPLICATION

The present application claims priority under 35 U.S.C. § 119 to U.S. Provisional Patent Application Ser. No. 62/850,040, filed May 20, 2019, the entire content of which is incorporated herein by reference.

BACKGROUND

The present invention generally relates to radio communications and, more particularly, to base station antennas for cellular communications systems.

Cellular communications systems are well known in the art. In a typical cellular communications system, a geographic area is divided into a series of regions that are referred to as "cells" which are served by respective base stations. Each base station may include baseband equipment, radios and base station antennas that are configured to provide two-way radio frequency ("RF") communications with fixed and mobile subscribers that are within the cell served by the base station. In many cases, each cell is divided into "sectors." In one common configuration, a hexagonally shaped cell is divided into three 120° sectors in the azimuth plane, and each sector is served by one or more base station antennas that have an azimuth Half Power Beamwidth (HPBW) of about 65°. The antennas are often mounted on a tower, with the radiation beam ("antenna beam") that is generated by each antenna directed outwardly to serve a respective sector. Typically, a base station antenna includes one or more phase-controlled arrays of radiating elements, with the radiating elements arranged in one or more vertical columns when the antenna is mounted for use. Herein, "vertical" refers to a direction that is perpendicular to the horizontal plane that is defined by the horizon. Reference will also be made to the azimuth plane, which is a horizontal plane that bisects the base station antenna, and to the elevation plane, which is a plane extending along the boresight pointing direction of the antenna that is perpendicular to the azimuth plane In order to accommodate the increasing volume of cellular communications, cellular operators have added cellular service in a variety of new frequency bands. Cellular operators typically want to limit the number of base station antennas that are deployed at a given base station, and hence so-called multi-band base station antennas are now routinely deployed in order to support cellular service in multiple frequency bands without increasing the number of base station antennas. Multi-band base station antennas often include multiple linear arrays of radiating elements that are configured to operate in different frequency bands. Additionally, one or more of the linear arrays may be implemented using so-called "wideband" radiating elements that can be used to support service in two or more different frequency bands. For example, linear arrays of wideband radiating elements are routinely used that operate across the 1695-2690 MHz frequency band, which includes a number of distinct sub-bands that support different types of cellular service. Unfortunately, it may be more difficult to meet performance specifications when wideband radiating elements are used as ensuring performance over larger frequency ranges may be difficult, and performance specifications may be more difficult to meet in antennas that include multiple arrays of radiating elements because the arrays may interact with each other in unintended ways.

Radiating elements are known in the art that include parasitic conductive elements. In particular, Chinese Patent Application No. 201621382671.X, filed Dec. 16, 2016 (Chinese Publication No. CN 206259489 U) discloses a radiating element that has printed circuit board-based dipole radiators that include a conductive element on the reverse side of the printed circuit board. An exploded perspective view of one of the radiating elements disclosed in the above-referenced Chinese patent application is reproduced herein as FIG. 10. The radiating element depicted in FIG. 10 includes cross-dipole radiators that are formed on a printed circuit board that has a dielectric substrate 6, a top metal pattern 4 and a bottom metal pattern 5. The printed circuit board that includes the dipole radiators is mounted on a feed stalk structure 21.

SUMMARY

Pursuant to embodiments of the present invention, a radiating element for a base station antenna is provided that includes a first dipole radiator that includes a first dipole arm that has a front surface and first and second extensions that project rearwardly from respective side edges of the front surface of the first dipole arm and a second dipole radiator that includes a second dipole arm that has a front surface and first and second extensions that project rearwardly from respective side edges of the front surface of the second dipole arm. The radiating element further includes a parasitic element having a first conductive segment that is configured to capacitively couple to the first extension of the first dipole arm, a second conductive segment that is configured to capacitively couple to the second extension of the second dipole arm, and a third conductive segment that electrically connects the first conductive segment to the second conductive segment.

In some embodiments, the first conductive segment may be positioned adjacent a rear edge of the first extension of the first dipole arm and the second conductive segment is positioned adjacent a rear edge of the second extension of the second dipole arm.

In some embodiments, the first conductive segment, the second conductive segment and the third conductive segment of the parasitic element may define an open-ended triangle.

In some embodiments, the first conductive segment, the second conductive segment and the third conductive segment of the parasitic element may all be positioned between the first dipole arm and the second dipole arm.

In some embodiments, the first dipole radiator may further include a third dipole arm that has a front surface and first and second extensions that project rearwardly from respective side edges of the front surface of the third dipole arm, and the second dipole radiator further includes a fourth dipole arm that has a front surface and first and second extensions that project rearwardly from respective side edges of the front surface of the fourth dipole arm.

In some embodiments, the parasitic element may be a first parasitic element and the radiating element may also include second, third and fourth parasitic elements.

In some embodiments, the first dipole arm may further include a third extension that projects rearwardly from a distal end of the front surface of the first dipole arm, and the fourth dipole arm may similarly include a third extension that projects rearwardly from a distal end of the front surface of the fourth dipole arm.

In some embodiments, the first dipole arm may further include a third extension that projects rearwardly from a distal end of the front surface of the first dipole arm, and the second dipole arm may not include an extension that projects rearwardly from a distal end of the front surface of the second dipole arm.

In some embodiments, the parasitic element may be configured so that when the first dipole arm is excited, current flows outwardly on the first dipole arm and current flows inwardly on the first conductive segment.

In some embodiments, each of the first conductive segment, the second conductive segment and the third conductive segment of the parasitic element may be an elongated element having a length, a width and a depth, where the length exceeds the width and the depth by at least a factor of ten.

In some embodiments, the parasitic element may be attached to at least one of the first extension of the first dipole arm and the second extension of the second dipole arm by a dielectric fastener.

In some embodiments, an array of any of the above described radiating elements may be included in a base station antenna that includes a reflector that defines a substantially vertical plane. Each of the radiating elements may be mounted to extend forwardly from the reflector. The antenna may further include first and second RF ports, a first feed network that connects the first RF port to the first dipole radiators of the radiating elements in the array and a second feed network that connects the second RF port to the second dipole radiators of the radiating elements in the array.

Pursuant to further embodiments of the present invention, a radiating element for a base station antenna is provided that includes a first dipole radiator that includes a first dipole arm and a third dipole arm that each extend along a first axis, a second dipole radiator that includes a second dipole arm and a fourth dipole arm that each extend along a second axis that is substantially perpendicular to the first axis, and a first parasitic element having a first conductive segment adjacent the first dipole arm, a second conductive segment adjacent the second dipole arm, and a third conductive segment that electrically connects the first conductive segment to the second conductive segment. All three of the first through third conductive segments are positioned in a space defined between the first dipole arm and the second dipole arm.

In some embodiments, the first through fourth dipole arms may each have a respective front surface and respective first and second extensions that project rearwardly from respective side edges of the respective front surfaces. In some embodiments, the first conductive segment may be configured to capacitively couple to the first extension of the first dipole arm and the second conductive segment is configured to capacitively couple to the second extension of the second dipole arm.

In some embodiments, the first conductive segment, the second conductive segment and the third conductive segment of the parasitic element may define an open-ended triangle.

In some embodiments, the parasitic element may be configured so that when the first dipole arm is excited, current flows outwardly on the first dipole arm and current flows inwardly on the first conductive segment.

In some embodiments, each of the first conductive segment, the second conductive segment and the third conductive segment of the parasitic element may be an elongated element having a length, a width and a depth, where the length exceeds the width and the depth by at least a factor of fifteen.

In some embodiments, the parasitic element may be attached to at least one of the first extension of the first dipole arm and the second extension of the second dipole arm by a dielectric fastener.

Pursuant to still further embodiments of the present invention, a radiating element for a base station antenna is provided that includes a first dipole radiator that includes a first dipole arm and a third dipole arm that each extend along a first axis, a second dipole radiator that includes a second dipole arm and a fourth dipole arm that each extend along a second axis that is substantially perpendicular to the first axis, a first parasitic element that is mounted to the first dipole arm by a first dielectric fastener and to the second dipole arm by a second dielectric fastener, a second parasitic element that is mounted to the second dipole arm by a third dielectric fastener and to the third dipole arm by a fourth dielectric fastener, a third parasitic element that is mounted to the third dipole arm by a fifth dielectric fastener and to the fourth dipole arm by a sixth dielectric fastener, and a fourth parasitic element that is mounted to the fourth dipole arm by a seventh dielectric fastener and to the first dipole arm by an eighth dielectric fastener.

In some embodiments, each of the first through fourth parasitic elements may include a first conductive segment that is adjacent one of the first through fourth dipole arms to which the respective parasitic element is attached, a second conductive segment that is adjacent another of the first through fourth dipole arms to which the respective parasitic element is attached, and a third conductive segment that electrically connects the first conductive segment of the respective parasitic elements to the second conductive segment of the respective parasitic elements.

In some embodiments, the first conductive segment, the second conductive segment and the third conductive segment of each of the first through fourth parasitic elements may define a respective open-ended triangle.

In some embodiments, the first conductive segment, the second conductive segment and the third conductive segment of the first parasitic element may all be positioned between the first dipole arm and the second dipole arm.

In some embodiments, the first through fourth dipole arms may each have a respective front surface and respective first and second extensions that project rearwardly from respective side edges of the respective front surfaces, and the first conductive segment of the first parasitic element is positioned adjacent a rear edge of the first extension of the first dipole arm, and the second conductive segment of the first parasitic element may be positioned adjacent a rear edge of the second extension of the second dipole arm.

In some embodiments, all three of the first through third conductive segments of the first parasitic element may be positioned in a space defined between the first dipole arm and the second dipole arm.

In some embodiments, the first dipole arm further may include a third extension that projects rearwardly from a distal end of the front surface of the first dipole arm, and wherein the fourth dipole arm further includes a third extension that projects rearwardly from a distal end of the front surface of the fourth dipole arm.

In some embodiments, the second dipole arm does not include a third extension that projects rearwardly from a distal end of the front surface of the second dipole arm.

In some embodiments, the first parasitic element may be configured so that when the first dipole arm is excited, current flows outwardly on the first dipole arm and current flows inwardly on the first conductive segment.

DETAILED DESCRIPTION

Figure 2:
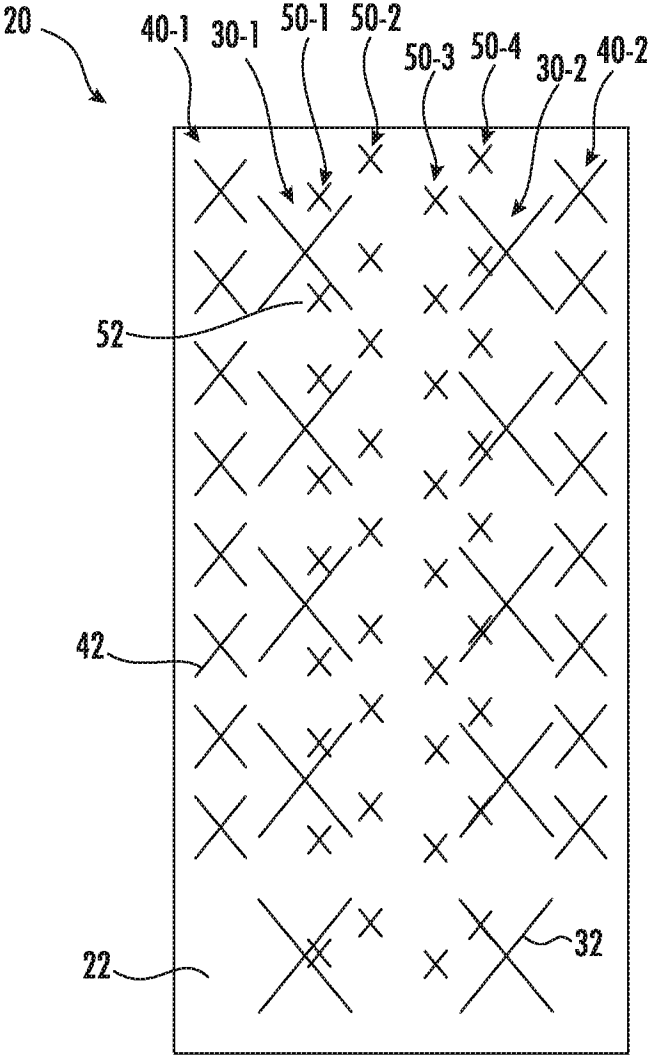
FIG. 2 is a schematic front view of an antenna assembly of the base station antenna of FIG. 1.

Pursuant to embodiments of the present invention, cross-dipole radiating elements are provided that include parasitic elements that expand the operating frequency band of the radiating elements. These parasitic elements may be disposed between adjacent dipole arms of the radiating elements, and may couple RF energy from a dipole arm having a first polarization to a dipole arm having a second polarization. The parasitic elements increase the lengths of the current path, and hence the effective lengths of the dipole arms. The parasitic elements may be designed so that RF energy in a particular frequency range preferentially couples to the parasitic elements, and hence the parasitic elements may act to primarily increase the effective lengths of the dipole arms for a selected frequency range, and to provide little or no increase in the effective lengths of the dipole arms for other frequency ranges. As a result of this design, the radiating elements according to embodiments of the present invention may be implemented using relatively small dipole radiators yet still operate with good performance across a wide frequency range.

In some embodiments, the cross-dipole radiating elements according to embodiments of the present invention may be designed so that RF energy in a lower frequency range couples from the dipole arms to the parasitic elements. In one specific embodiment, the radiating elements may be designed to operate in the 1427-2690 MHz frequency band, and the parasitic elements may be designed so that RF energy in the 1427-1518 MHz frequency range preferentially couples between the dipole arms and parasitic elements. In this fashion, the effective length of the dipole arms may be increased with respect to RF signals in 1427-1518 MHz frequency band, but may exhibit little or no increase in length at higher frequencies such as, for example, frequencies neat 2690 MHz. Thus, since the effective lengths of the dipole arms is made variable, the radiating element may be designed to resonate over a larger frequency range.

The cross-dipole radiating elements according to embodiments of the present invention may include a first dipole radiator that is configured to operate at a first polarization (e.g., a slant −45° polarization) and a second dipole radiator that is configured to operate at a second polarization (e.g., a slant +45° polarization) that is orthogonal to the first polarization. Each dipole radiator may comprise a center fed dipole radiator that includes first and second dipole arms so that the cross-dipole radiating element includes a total of four dipole arms that are arranged in the shape of an X. A total of four parasitic elements may be provided, with each parasitic element positioned between two adjacent dipole arms. In some embodiments, the parasitic elements may be located within the "footprint" of the dipole arms and hence may not increase the overall footprint of the cross-dipole radiating element.

In some embodiments, the dipole arms may be formed of sheet metal, which can reduce the cost of the radiating element. In some embodiments, each dipole arm may have a front surface and first and second extensions that project rearwardly from respective side edges of the front surface so that each dipole arm has a generally U-shaped cross-section. The dipole arms may be formed by forming two approximately 90° bends in a piece of sheet metal to form the first and second rearward extensions. The rearward extensions on each dipole arm may increase the current path along the respective dipole arm, thereby allowing the dipole arms to have a greater electrical length for a given physical length. Each parasitic element may include a first conductive segment that capacitively couples to the first rearward extension of a first of two adjacent dipole arms, a second conductive segment that capacitively couples to the second rearward extension of a second of two adjacent dipole arms, and a third conductive segment that electrically connects the first conductive segment to the second conductive segment. All three of the first through third conductive segments may be positioned in a space defined between the adjacent dipole arms in some embodiments. Each parasitic element may be mounted using dielectric fasteners to the pair of adjacent dipole arms between which the parasitic element is located.

The parasitic elements may be mounted using dielectric fasteners that attach each parasitic element to the two dipole arms that the parasitic element couples RF energy therebetween. The dielectric fasteners may be configured to mount each parasitic element so that it is spaced apart from its associated dipole arms by a predetermined distance so that the parasitic element capacitively couples with the dielectric arms. In an example embodiment, the dielectric fasteners may be implemented as snap clips. However, any appropriate fastener may be used including, for example, screws, rivets, interference fit spacers and the like.

In some embodiments, the radiating elements may have "unbalanced" dipole arms, meaning that some of the dipole arms have different electrical lengths than others of the dipole arms. For example, one or both of the dipole arms that project downwardly (i.e., at 45° angles toward the ground) when a base station including the radiating elements is mounted for normal use may have increased electrical lengths as compared to the dipole arms that point upwardly (toward the sky). The use of such unbalanced dipole arms may improve the electrical performance of the antenna when the linear arrays of radiating elements are operating at relatively large electronic downtilts.

Embodiments of the present invention will now be described in further detail with reference to the attached figures.

Figure 1:
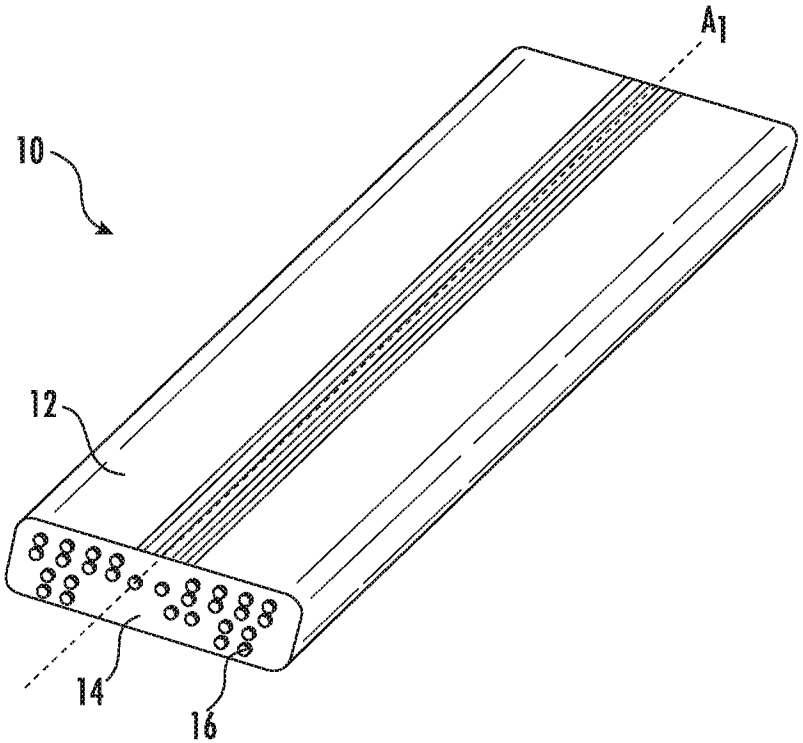
FIG. 1 is a perspective view of a base station antenna.

FIGS. 1 and 2 illustrate an example base station antenna 10 in which the wideband cross-dipole radiating elements according to embodiments of the present invention may be used. In the description that follows, the antenna 10 will be described using terms that assume that the antenna 10 is mounted for use with the longitudinal axis $A_1$ of the antenna 10 extending along a vertical axis and the front surface of the antenna 10 pointing toward the coverage area for the antenna 10.

Referring to FIG. 1, the base station antenna 10 is an elongated structure that extends along the longitudinal axis $A_1$. The antenna 10 includes a radome 12 and a bottom end cap 14 which includes a plurality of connectors 16 mounted therein. One or more mounting brackets (not visible) may be provided on the rear side of the antenna 10 which may be used to mount the antenna 10 onto an antenna mount of an antenna tower. The radome 12 and bottom end cap 14 may form an external housing for the antenna 10. An antenna assembly 20 is contained within the housing (FIG. 2).

FIG. 2 is a schematic front view of the antenna assembly 20 of base station antenna 10. As shown in FIG. 2, the antenna assembly 20 includes a reflector 22 that comprises a generally flat metallic surface that has a longitudinal axis that may extend parallel to the longitudinal axis $A_1$ of the antenna 10. The reflector 22 may serve as both a structural component for the antenna assembly 20 and as a ground plane for the radiating elements mounted thereon.

The antenna assembly 20 includes respective pluralities of dual-polarized low-band radiating elements 32, mid-band radiating elements 42 and high-band radiating elements 52 that extend forwardly from the reflector 22. The low-band radiating elements 32 are mounted in two columns to form two linear arrays 30-1, 30-2 of low-band radiating elements 32. It should be noted that herein like elements may be referred to individually by their full reference numeral (e.g., linear array 30-2) and may be referred to collectively by the first part of their reference numeral (e.g., the linear arrays 30). The low-band radiating elements 32 may be configured to transmit and receive signals in a first frequency band such as, for example, the 617-960 MHz frequency range or a portion thereof.

The mid-band radiating elements 42 may likewise be mounted in two columns to form two linear arrays 40-1, 40-2 of mid-band radiating elements 42. The linear arrays 40-1, 40-2 of mid-band radiating elements 42 may extend along the respective side edges of the reflector 22. The mid-band radiating elements 42 may be configured to transmit and receive signals in a second frequency band such as, for example, the 1427-2690 MHz frequency range or a portion thereof.

The high-band radiating elements 52 are mounted in four columns in the center of antenna 10 to form four linear arrays 50-1 through 50-4 of high-band radiating elements 52. The high-band radiating elements 52 may be configured to transmit and receive signals in a third frequency band. In some embodiments, the third frequency band may comprise the 3300-4200 MHz frequency range or a portion thereof.

Each linear array 30, 40, 50 may be configured to provide service to a sector of a base station. For example, each linear array 30, 40, 50 may be configured to provide coverage to approximately 120° in the azimuth plane so that the base station antenna 10 may act as a sector antenna for a three-sector base station. All of the radiating elements 32, 42, 52 are implemented as slant −45°/+45° cross-polarized dipole radiating elements that have a first dipole radiator that can transmit and receive first RF signals at a −45° polarization and that have a second dipole radiator that can transmit and receive second RF signals at a +45° polarization.

Figure 3A:
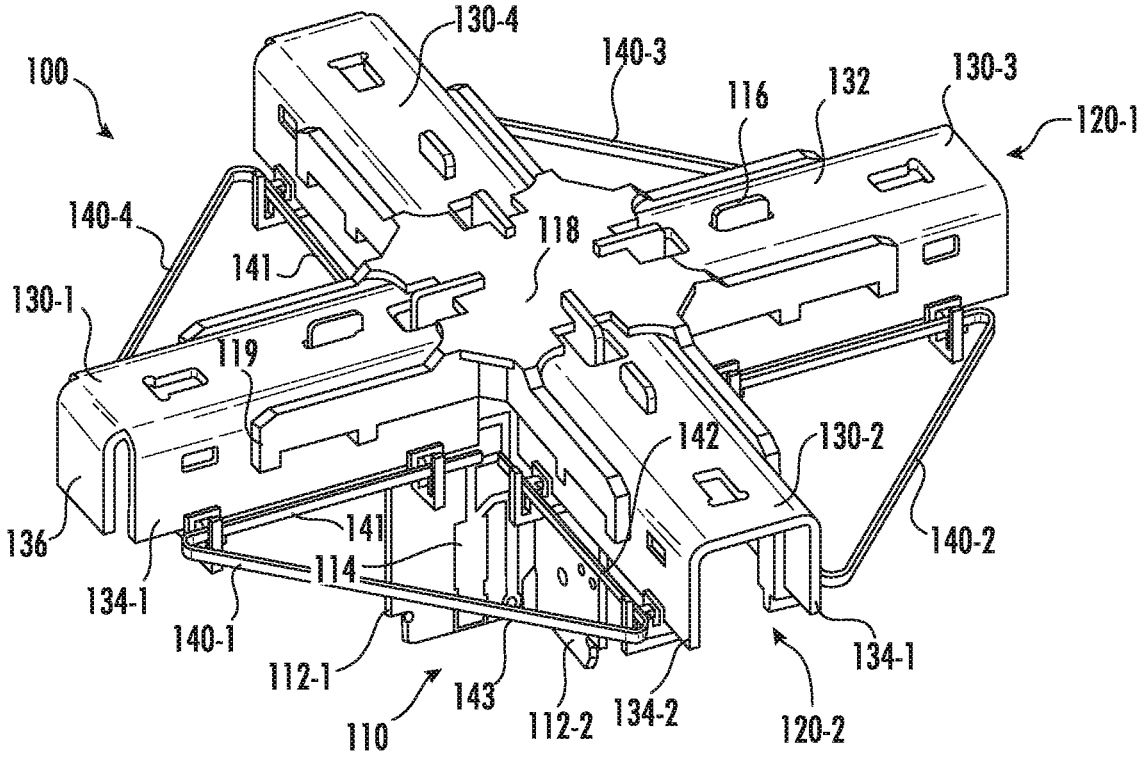
FIG. 3A is a perspective view of one of the radiating elements included in the base station antenna of FIGS. 1-2.
Figure 3B:
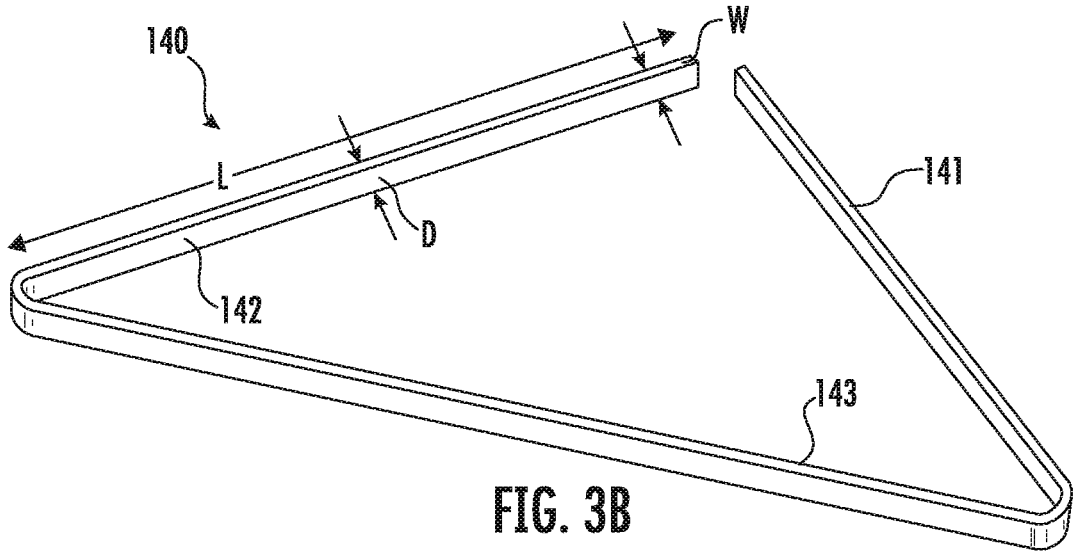
FIG. 3B is an enlarged perspective view of one of the parasitic elements included in the radiating element of FIG. 3A.

FIG. 3A is a perspective view illustrating a mid-band radiating element 100 that may be used to implement the mid-band radiating elements 42 included in the base station antenna 10 of FIGS. 1-2 FIG. 3B is an enlarged perspective view of one of the parasitic elements included in the radiating element of FIG. 3. FIG. 3C is an enlarged view of a small portion of the radiating element 100 that illustrates how plastic snap clips may be used to attach the parasitic elements to the dipole arms of the radiating element. In FIG. 3A, the radiating element 100 is oriented as it would appear when the reflector 22 (not shown) is located beneath the radiating element 100. In use, the radiating element 100 will be rotated 90° from the orientation shown in FIG. 3A so that the radiating element 100 extends forwardly from the reflector 22.

As shown in FIG. 3A, the mid-band radiating element 100 includes first and second dipoles radiators 120-1, 120-2 that are mounted on a feed stalk 110. The first dipole radiator 120-1 may be positioned at an angle of −45° with respect to the longitudinal axis of the antenna 10 when mounted on a reflector 22, and the second dipole radiator 120-2 may be positioned at an angle of +45° with respect to the longitudinal axis of the antenna 10 when mounted on a reflector 22. Four dipole arms 130-1 through 130-4 are used to form dipole radiators 120-1, 120-2, with dipole radiator 120-1 including dipole arms 130-1, 130-3, and dipole radiator 120-2 including dipole arms 130-2, 130-4.

The feed stalk 110 may comprise first and second printed circuit boards 112-1, 112-2 that include RF transmission lines 114 thereon. The printed circuit boards 112-1, 112-2 may further include hook baluns, capacitors, inductors and the like (not shown). The printed circuit boards 112-1, 112-2 may be used to couple the first and second dipole radiators 120-1, 120-2 to respective first and second feed networks (not shown) of the antenna 10. The first feed network may connect a first radio frequency port 16 of the antenna 10 to the slant −45° dipole radiators 120-1 of the first array 40-1 of mid-band radiating elements 42 (which are implemented as radiating elements 100), and the second feed network may connect a second radio frequency port 16 of the antenna 10 to the slant +45° dipole radiators 120-2 of the first array 40-1 of mid-band radiating elements 42. The dipole arms 130 may be physically and electrically connected to the feed stalk printed circuit boards 112-1, 112-2 by soldering upwardly extending tabs 116 on the printed circuit boards 112 to the dipole arms 130. Alternatively, the dipole arms 130 may be capacitively coupled to the feed stalk printed circuit boards 112-1, 112-2. For example, FIG. 3D is an exploded perspective view of a mid-band radiating element 100A that is an alternative embodiment of the mid-band radiating element 100 of FIG. 3A. The mid-band radiating element 100A is very similar to mid-band radiating element 100, but further includes a coupling printed circuit board 113 that is mounted on and directly electrically connected to the feed stalk printed circuit boards 112-1, 112-2. The coupling printed circuit board 113 may be galvanically connected to the RF transmission lines 114 on the feed stalk printed circuit boards 112-1, 112-2 and may be capacitively coupled with the dipole arms 130. As another example, FIG. 3E is a schematic perspective view of a mid-band radiating element 100B that is another alternative embodiment of the mid-band radiating element 100 of FIG. 3A. The mid-band radiating element 100B has dipole arms 130A that have been modified to allow the RF transmission lines 114 on the feed stalk printed circuit boards 112-1, 112-2 to capacitively couple directly to the respective dipole arms 130. In each of these embodiments (although not shown in FIG. 3E), a dielectric support 118 may be provided that attaches to the four dipole arms 130 in order to maintain the dielectric arms 130 in their proper positions. The dielectric support 118 may include a plurality of cantilevered snap clips 119 that mate with matching recesses 138 in the dipole arms 130.

Each dipole arm 130 includes a front surface 132 and first and second rearward extensions 134-1, 134-2 that extend rearwardly from opposed sides of the front surface 132. The dipole arms 130 may also optionally include a third rearward extension 136 that extends rearwardly from the distal end of the dipole arm 130. In the depicted embodiment, the rearward extension 136 extends at a right angle from the distal end of the front surface 132 of the dipole arm 130. It will be appreciated that in other embodiments the rearward extension 136 may alternatively extend, for example from one or both of the first and second rearward extensions 134-1, 134-2. Each dipole arm 130 may be formed from sheet metal that is cut and bent into the shape shown in FIG. 3A. The dipole arms 130 may be manufactured at very low cost, and may any desired thickness. The thickness may be selected based on a desired operating bandwidth (increasing the thickness of a dipole, while holding all other parameters constant, typically increases the operating bandwidth of the dipole) and cost considerations.

Referring to FIGS. 3A and 3B, the radiating element 100 further includes first through fourth parasitic elements 140-1 through 140-4. Each parasitic element 140 is implemented as an elongate strip of metal that is bent into an open-ended triangular shape. As such, each parasitic element 140 includes first through third conductive segments 141-143 that are integral with each other. The first conductive segment 141 is positioned adjacent the first rearward extension 134-1 of a first of the dipole arms 130, second conductive segment 142 is positioned adjacent the second rearward extension 134-2 of a second of the dipole arms 130, and the third conductive segment 143 physically and electrically connects a first end of the first conductive segment 141 to a first end of the second conductive segment 142. The second ends of the first and second conductive segments 141, 142, which are the ends closest to the feed stalk 110, do not meet so that the parasitic element 140 has the open-ended triangular shape. Each conductive segment 141-143 may have a length, a width and a depth dimension, where the length dimension extends along the longitudinal axis of the conductive segment and the width and depth dimensions are perpendicular to the length dimension and perpendicular to each other. The length (L), width (W) and depth (D) dimensions are indicated in FIG. 3B. In some embodiments, the length of each conductive segment 141-143 may be at least ten times greater than both the width and the depth of the respective conductive segments 141-143. In other embodiments, the length of each conductive segment 141-143 may be at least fifteen, or at least twenty, times greater than both the width and the depth of the respective conductive segments 141-143.

Figure 3C:
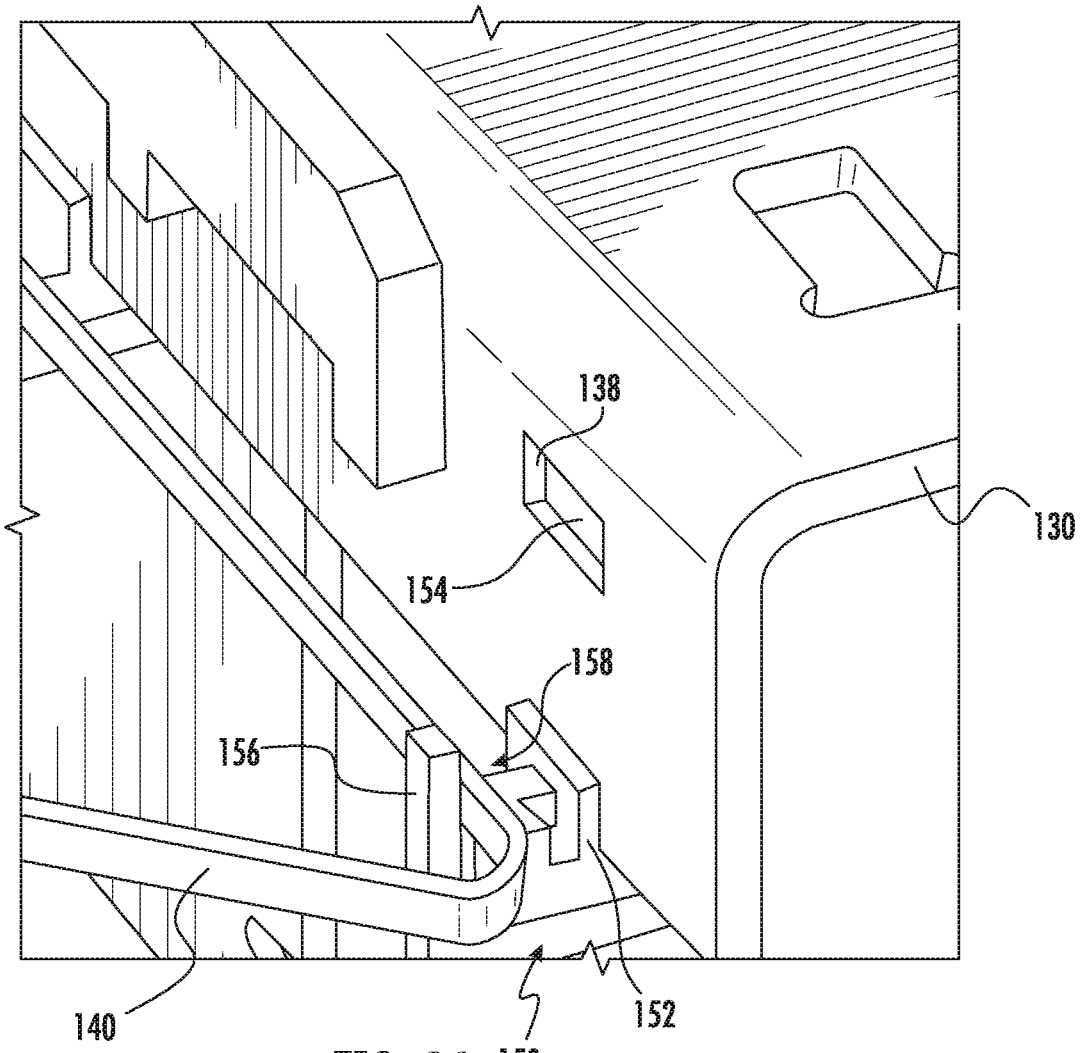
FIG. 3C is an enlarged view of a small portion of the radiating element of FIG. 3A that illustrates how plastic snap clips may be used to attach the parasitic elements to the dipole arms of the radiating element.
Figure 3D:
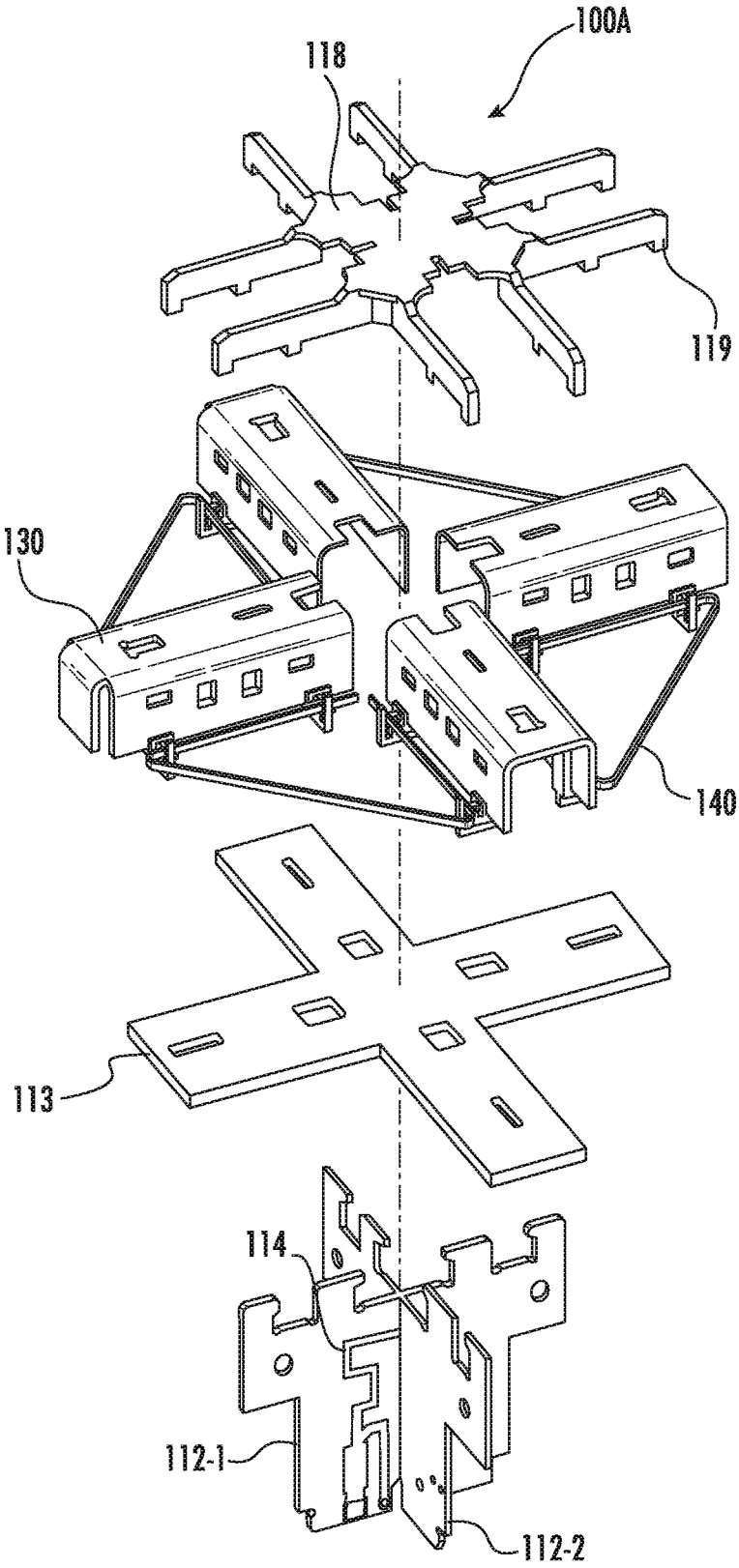
FIGS. 3D and 3E are schematic views of alternate embodiments of the radiating element of FIG. 3A in which the feed stalk printed circuit boards are capacitively coupled to the dipole arms of the radiating element.
Figure 3E:
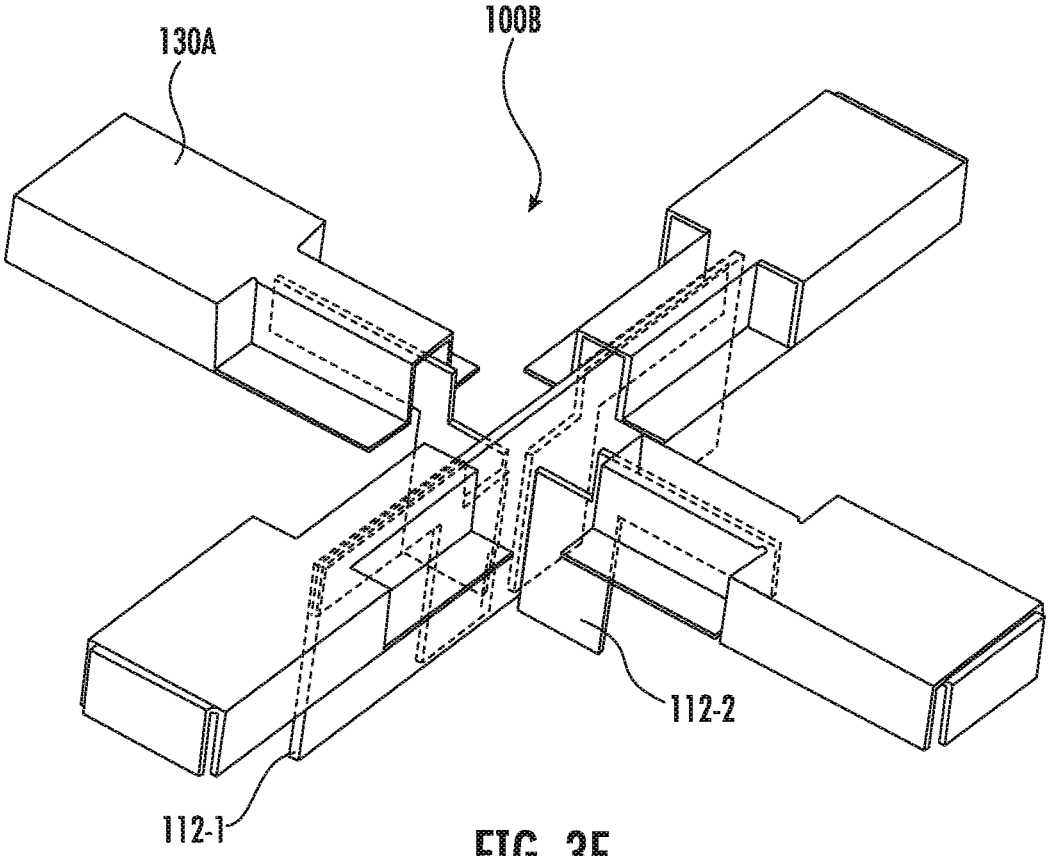

Referring to FIGS. 3A and 3C, it can be seen that each parasitic element 140 is attached to the two dipole arms 130 between which the parasitic element 140 is mounted. For example, parasitic element 140-1 is attached to dipole arms 130-1 and 130-4. Dielectric fasteners may be used to mount each parasitic element 140 to its associated dipole arms 130. In the depicted embodiment, the dielectric fasteners comprise clips 150 that attach to the dipole arms 130. As shown in the enlarged view of FIG. 3C, each clip 150 includes a first U-shaped channel 152 (only partially visible in FIG. 3C) that receives a rear edge of one on the rearward extensions 134 of the dipole arm 130. The side of the first U-shaped channel 152 that is not visible in FIG. 3C also forms a cantilevered snap clip, and a hook 154 at the distal end of this snap clip is received within a recess in the rearward extension 134 of the dipole arm 130. The first U-shaped channel 152 and snap clip together attach the clip 150 to the dipole arm 130. The clip 150 includes a second cantilevered snap clip 156 that defines a second channel 158 that is between the U-shaped channel 152 and the second cantilevered snap clip 156. The parasitic element 140 is received within the second U-shaped channel 158 and held firmly in place by the snap clip 156.

Operation of the parasitic elements 140 will now be discussed with reference to parasitic element 140-1, which is representative, with reference to FIGS. 3A-3B and 4A-4B. As shown in FIG. 3A, the first conductive segment 141 extends parallel to the first dipole arm 130-1 adjacent a rearmost portion of the first rearward extension 134-1 of dipole arm 130-1. The first conductive segment 141 may therefore capacitively couple energy to and/or from the first dipole arm 130-1. Similarly, the second conductive segment 142 extends parallel to the second dipole arm 130-2 adjacent a rearmost portion of the second rearward extension 134-2 of dipole arm 130-2. The second conductive segment 142 may therefore capacitively couple energy to and/or from the second dipole arm 130-2.

Various parameters such as, for example, the distance of the first and second conductive segments 141, 142 from the respective first and second dipole arms 130-1, 130-2, the lengths and depths of the first and second conductive segments 141, 142, and the transverse cross-sectional area of the first and second conductive segments 141, 142, may be selected to control the frequency band over which RF energy will readily couple between the first and second conductive segments 141, 142 and the respective first and second dipole arms 130-1, 130-2, as well as the amount of RF energy that will couple. In some embodiments, these parameters so that RF energy in the lower portion of the operating frequency band of radiating element 100 can pass to the parasitic elements 140 while RF energy at frequencies in the upper portion of the operating frequency band is mostly blocked from passing to the parasitic elements 140. The two conductive segments 141, 142 of parasitic element 140-1, the respective dipole arms 130-1, 130-2, and the respective air gaps therebetween form respective capacitors, while the small transverse cross-sectional area of the conductive segments 141, 142 of parasitic element 140-1 form inductors so that each conductive segment 141, 142 is connected to its associated dipole arm 130-1, 130-2 via the equivalent of an inductive-capacitive (L-C) circuit. The L-C circuit may act as a low pass filter that allows RF signals in a lower portion of the operating frequency band of the radiating element 100 to pass from the dipole arms 130-1, 130-2 to the respective conductive segments 141, 142, while largely blocking RF signals in upper portions of the operating frequency band from passing to the conductive segments 141, 142.

Figure 4A:
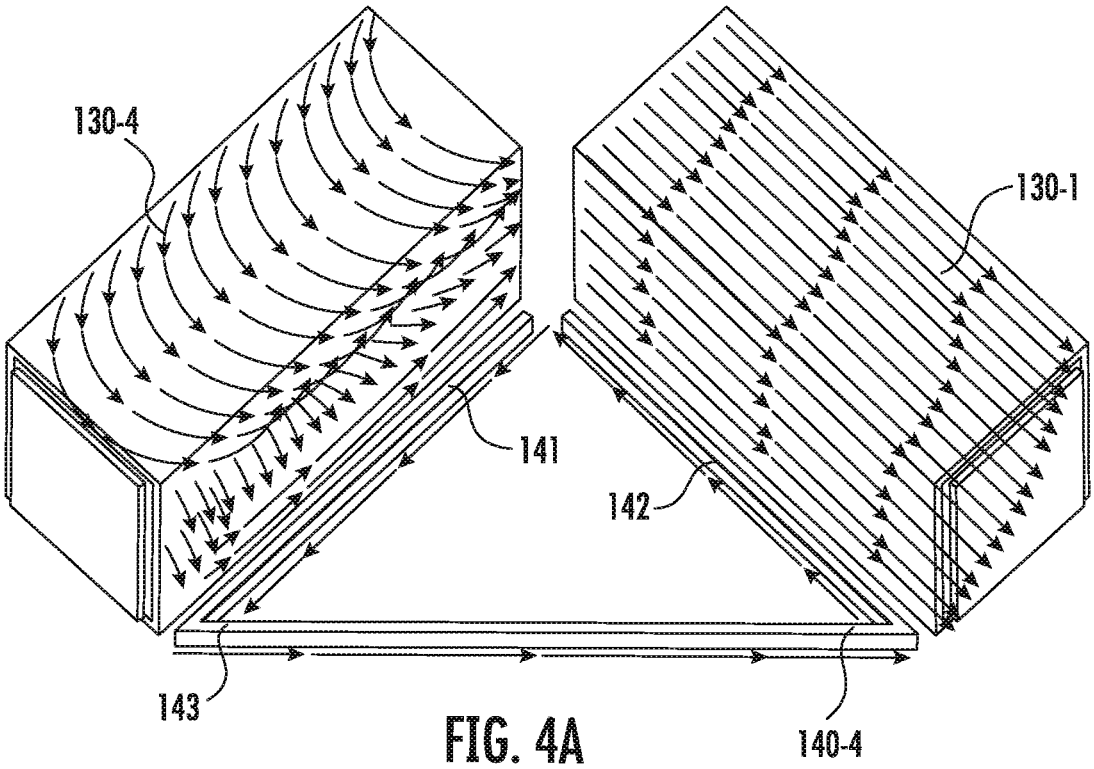
FIG. 4A is a perspective view of two of the dipole arms and one of the parasitic elements of the radiating element of FIG. 3A that illustrate the direction and density of the current flow on the dipole arms and parasitic element.

FIG. 4A is a perspective view of dipole arms 1304, 130-4 and parasitic element 140-4 of radiating element 100 of FIG. 3 that illustrates the direction and density of the current flow on these structures. In FIG. 4A, the direction of the current flow is shown using arrows, and the color of the arrows represent the current density, with the blue, green, yellow, orange and red arrows representing increasingly higher levels of current density. As shown in FIG. 4A, when dipole arm 1304 is excited by an RF signal input thereto from the feed stalk 110, current flows outwardly along dipole arm 130-1 with a heavy current density. As is further shown in FIG. 4A, current also flows along the parasitic element 140-4 in the opposite direction to the current flow on dipole arm 130-1. The current flows in the opposite direction on the parasitic element 140-4 because it is an induced current that is induced on the parasitic element 140-4. Induced currents typically flow in a direction opposite the direction of the current flow on the (excited) current source. By selecting, for example, the length of the conductive segment 142 of parasitic element 140-4 as well as the distance of conductive segment 142 from parasitic element 140-4 and the cross-sectional area of conductive segment 142 that faces parasitic element 140-4 a designer can ensure that the direction of current flow on parasitic element 140-4 is opposite the direction of the current flow on dipole arm 130-1. The current flow along the first conductive segment 141 and along the third conductive segment 143 of the parasitic element 140-4 appears as current flow along an additional length of conductor, and hence effectively increases the electrical length of dipole arm 130-1.

Figure 4B:
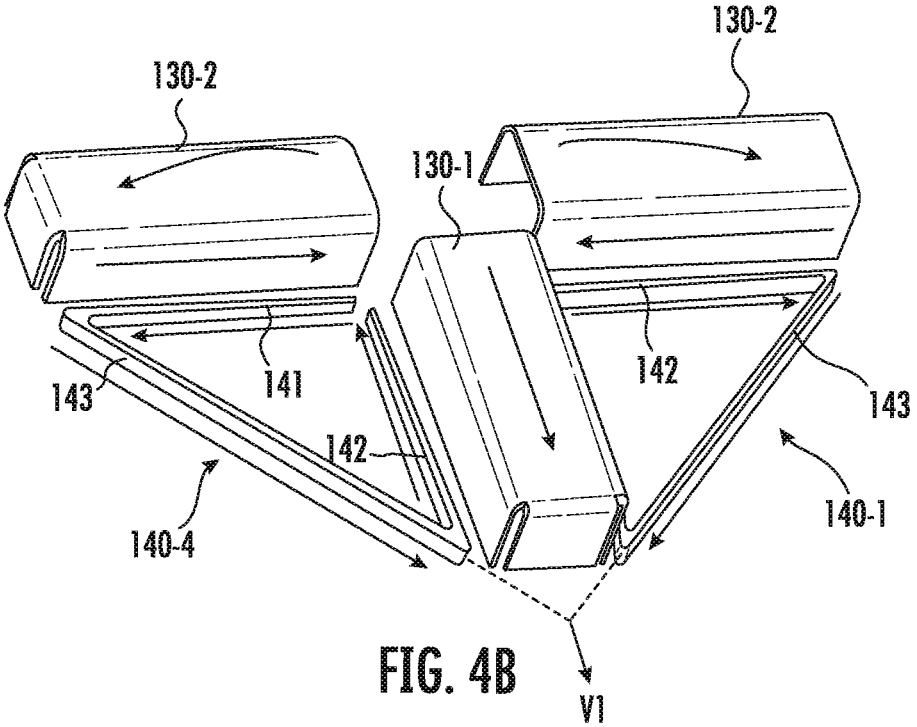
FIG. 4B is a schematic drawing illustrating current flow along two of the parasitic elements of the radiating element of FIG. 3A and three of the dipole arms when the middle dipole arm is fed an RF signal.

FIG. 4B is a schematic drawing illustrating current flow along the two parasitic elements 140-1, 140-4 that are adjacent to dipole arm 130-1 when dipole arm 130-1 is excited. As shown in FIG. 4B, the current flow along parasitic element 140-4 is again in the "opposite" direction to the current flow along dipole arm 130-1. Notably, the current flow along the third conductive segment 143 of parasitic element 140-1 and along the third conductive segment 143 of parasitic element 140-4 are towards each other. The polarization of the radiation emitted by the combination of the current flow along these two conductive segments 143 will be along a vector V1 that bisects the angle formed by the imaginary extensions of the current paths. As shown in FIG. 4B, this vector V1 is parallel to the current flow along dipole arm 130-1, and hence will also have −45° polarization. Similarly, the current flow along the second conductive segment 142 of parasitic element 140-1 and along the first conductive segment 141 of parasitic element 140-4 will again (in combination) generate radiation emitted along the vector V1, and hence will also have −45° polarization.

As is further shown in FIGS. 4A and 4B, currents also flow along the rearward extensions 134 of dipole arms 130-2 and 130-4 in response to excitation of dipole arm 130-1. The currents flowing along the rearward extensions 134 of dipole arms 130-2 and 130-4 flow towards each other, and hence effectively cancel each other out, and hence do not contribute to cross-polarization radiation.

Thus, as described above, the parasitic elements 140 act to increase the length of the current path for RF signals in the lower portion of the operating frequency band while providing less increase in the current path for RF signals in the upper portion of the operating frequency band. As such, the dipole has a variable electrical length and hence may be designed to resonate over a larger operating frequency band. Moreover, the physical "footprint" of the radiating element (which is defined here as the smallest square inside which the radiating element can fit when viewed from the front) may be kept relatively small, since the parasitic elements 140 are within the footprint of the dipole radiators 120 and hence extend the electrical length of the dipole radiators 120 without increasing the size of the footprint thereof.

Figure 5A:
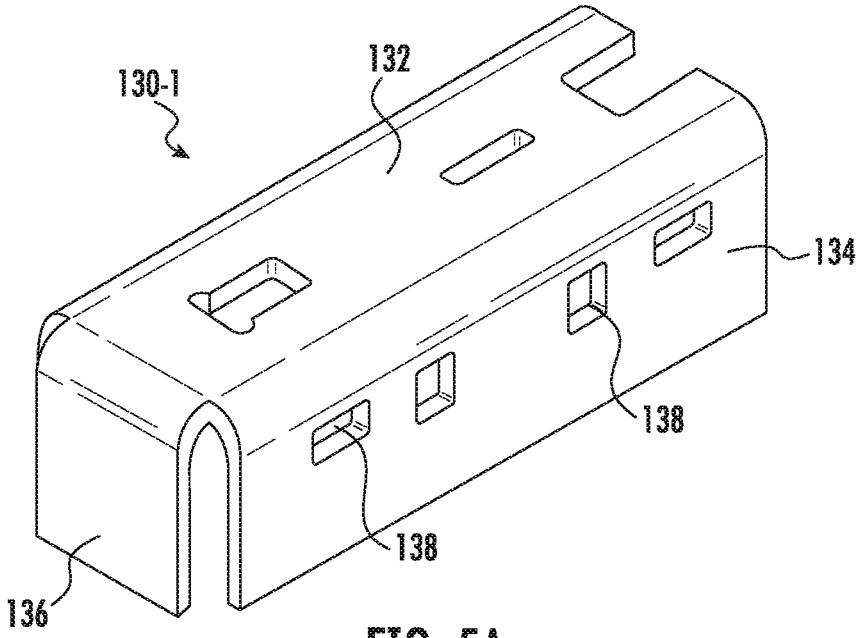
FIGS. 5A and 5B are perspective views of one of the bottom dipole arms and one of the top dipole arms, respectively, of the radiating element of FIG. 3A.
Figure 5B:
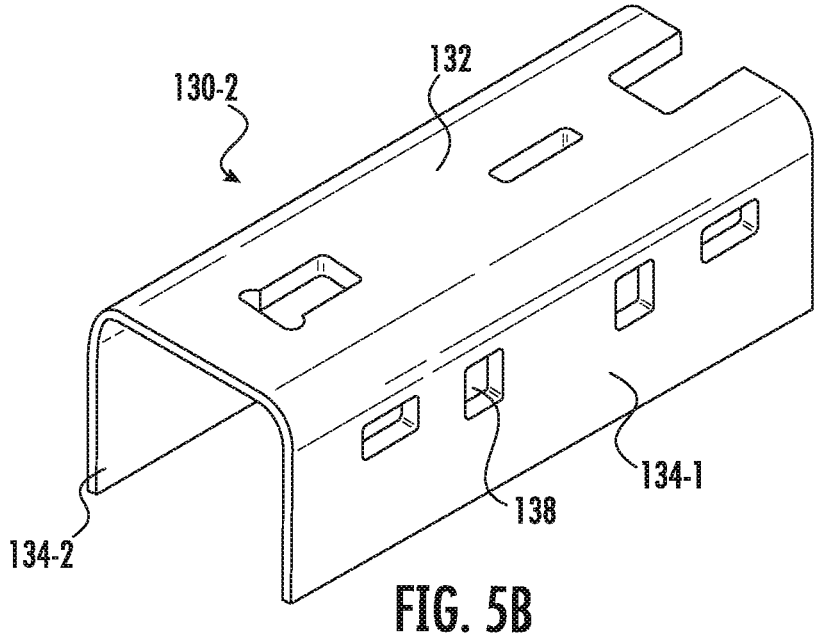

FIGS. 5A and 5B are perspective views of dipole arms 1304 and 130-2, respectively, of the mid-band radiating element 100 of FIG. 3. As shown in FIGS. 5A and 5B, the dipole arms 1304, 130-2 differ in that dipole arm 130-1 includes a third rearward extension 136 that extends rearwardly from the distal end of the dipole arm 130, while dipole arm 130-2 does not include any third rearward extension 136.

One problem with some linear arrays of radiating elements is that when large electronic tilts (e.g., downtilts) are applied to the antenna beam generated by the linear array in order to decrease the size of the coverage area, various characteristics of the antenna beam such as the azimuth HPBW, the 3 dB squint performance, and/or the cross-polarization discrimination ratio may be degraded. Pursuant to embodiments of the present invention, "unbalanced" dipole radiators may be used that may help counteract some of the performance degradation that may occur when the antenna is operating with large electronic downtilts. In particular, one or both of the "downwardly" projecting dipole arms 130 (i.e., dipole arms 1304 and 130-4 in FIG. 3, which are the dipole arms 130 that project towards the bottom of the antenna/ground) include a third rearward extension 136, while dipole arms 130-2, 130-3 do not. The use of such unbalanced dipole arms 130 tends to improve various characteristics of the antenna beams when the linear array is operated at large downtilt angles, while having relatively little impact on the same characteristics of the antenna beams when operating at small downtilts or without downtilt. The improvement in performance that can be achieved by designing the radiating element 100 to have unbalanced dipole arms 130 is shown in FIGS. 6A-8B, which illustrate various performance parameters for radiating element 100 when radiating element 100 is implemented both with, and without, balanced dipole arms 130.

Figure 6A:
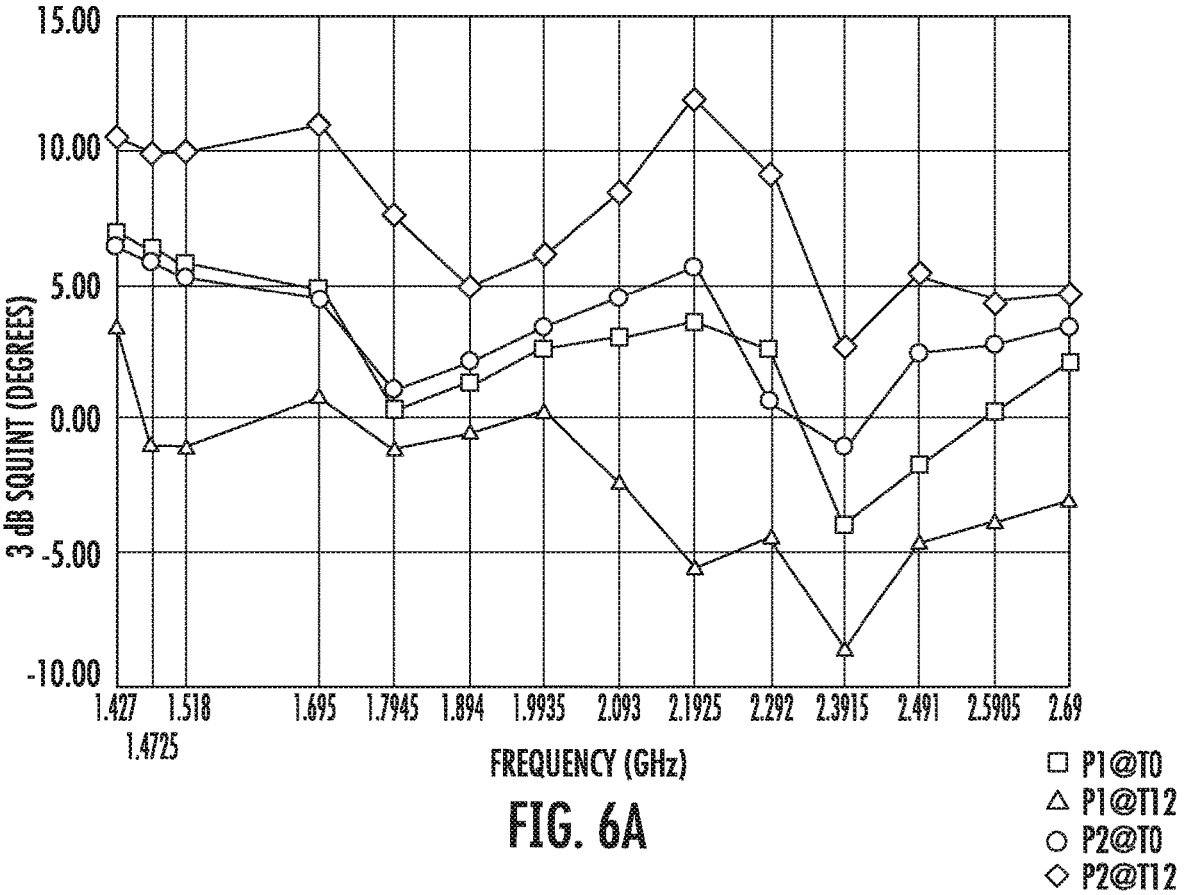
FIGS. 6A and 6B are graphs illustrating the 3 dB squint performance of first and second linear arrays according to embodiments of the present invention that are implemented with radiating elements having balanced (FIG. 6A) and unbalanced dipole arms (FIG. 6B).
Figure 6B:
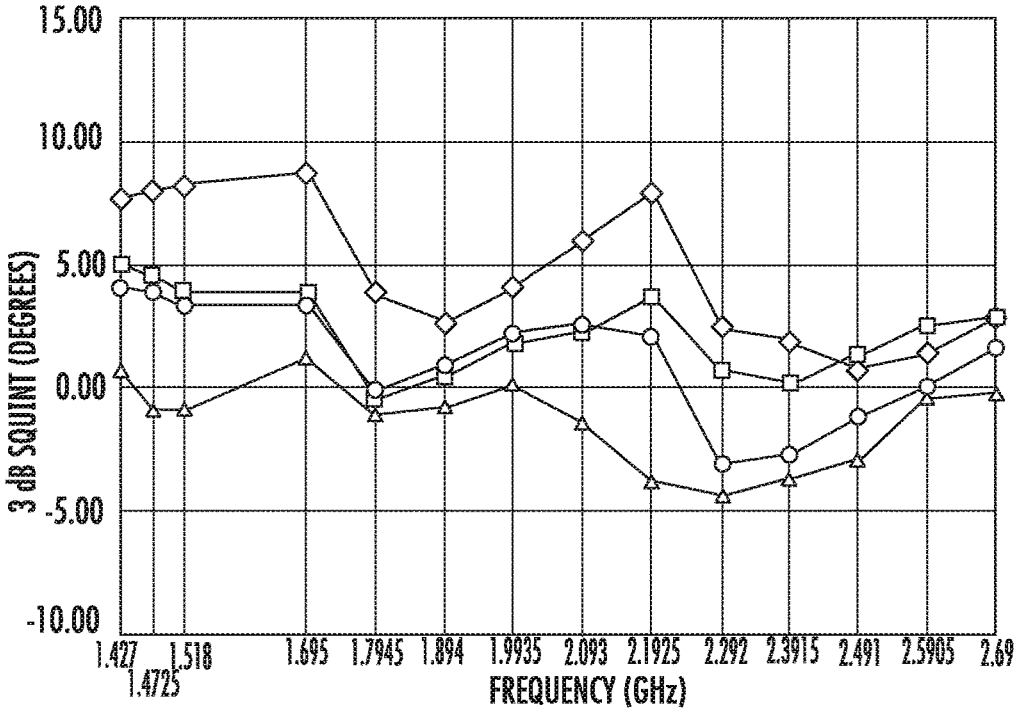

FIGS. 6A and 6B are graphs illustrating the 3 dB squint performance of a linear array of mid-band radiating elements according to embodiments of the present invention when implemented with balanced (FIG. 6A) and unbalanced dipole arms (FIG. 6B). Herein, a radiating element has "balanced" dipole arms if the dipole arms all have the same electrical length, whereas a radiating element has "unbalanced" dipole arms if at least one of the dipole arms has a different electrical length as compared to the other dipole arms. The squint performance of a linear array refers to a change in the boresight pointing direction of the antenna beam that occurs as a function of frequency, since the phase relationships of the signals transmitted/received by the individual radiating elements of the linear array vary with transmission frequency. In FIGS. 6A and 6B, the squint performance is shown for both polarizations (designated "P1" and "P2") at electronic downtilts of 0° ("T0") and at electronic downtilts of 12° ("T12"). As shown in FIG. 6A, if the radiating element 100 is modified to have all four dipole arms 130 implemented using the dipole arm design of FIG. 5B (i.e., none of the dipole arms 130 include the third rearward extension 136, and hence the radiating element is a balanced radiating element), then at electronic downtilts of 12°, high 3 dB squint values are seen. This results in degraded performance. As shown in FIG. 6B, if the linear array is instead implemented using the unbalanced radiating elements 100 of FIG. 3, the maximum variation of the 3 dB squint from 0° is reduced at electronic downtilts of 12° by about 3-5°, and the 3 dB squint performance is also improved in the case where no electronic downtilt is applied.

Figure 7A:
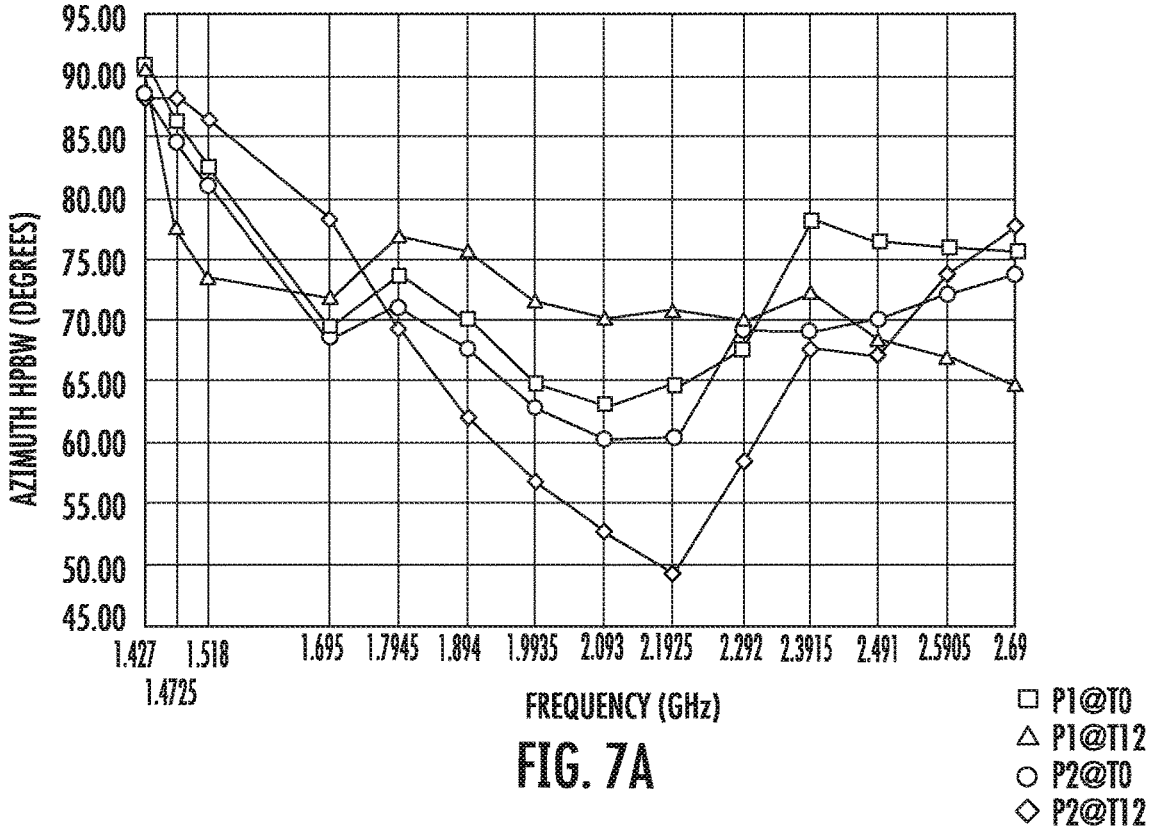
FIGS. 7A and 7B are graphs illustrating the 3 dB azimuth beamwidth performance of first and second linear arrays according to embodiments of the present invention that are implemented with radiating elements having balanced (FIG. 7A) and unbalanced dipole arms (FIG. 7B).
Figure 7B:
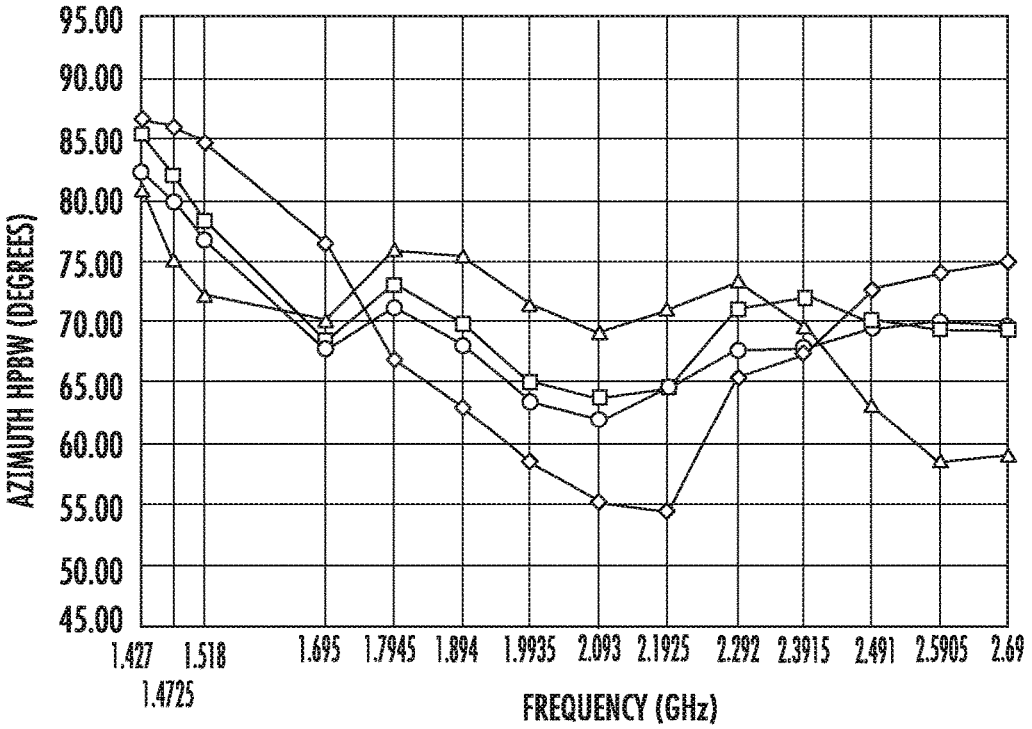

FIGS. 7A and 7B are graphs illustrating the azimuth HPBW performance of a linear array of mid-band radiating elements according to embodiments of the present invention when implemented with balanced (FIG. 7A) and unbalanced dipole arms (FIG. 7B). Typically, the ideal azimuth HPBW value for a base station antenna designed for use at a 3-sector base station is about 65°. As shown in FIG. 7A, when the radiating elements have balanced dipole arms, the azimuth HPBW varies between about 50° and 90° as a function of frequency. As shown in FIG. 7B, when the linear array is implemented using the unbalanced radiating elements 100 of FIG. 3, the variation in the azimuth HPBW as a function of frequency is reduced by about 9°. Moreover, the use of the unbalanced radiating elements 100 also reduces the variation in the 3 dB azimuth beamwidth as a function of frequency for the case where no electronic downtilt is applied.

Figure 8A:
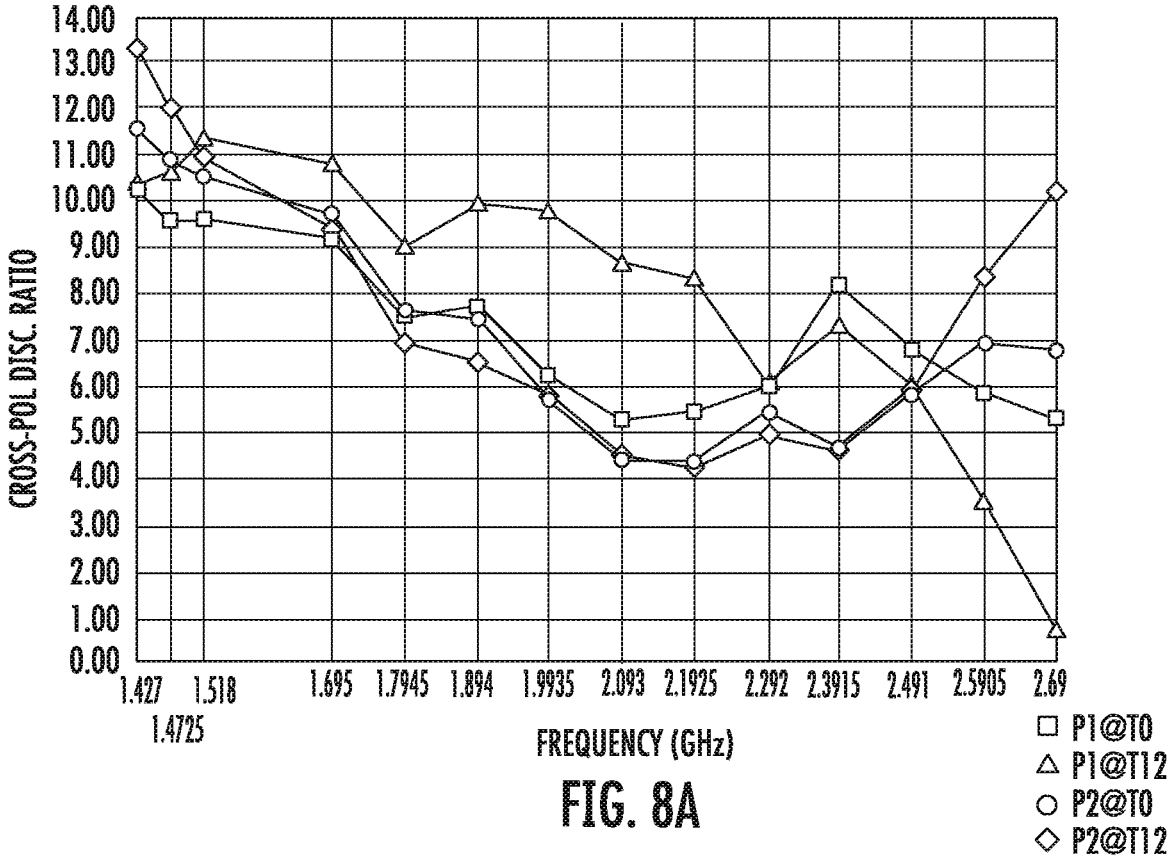
FIGS. 8A and 8B are graphs illustrating the cross-polarization discrimination ratio performance of first and second linear arrays according to embodiments of the present invention that are implemented with radiating elements having balanced (FIG. 8A) and unbalanced dipole arms (FIG. 8B).
Figure 8B:
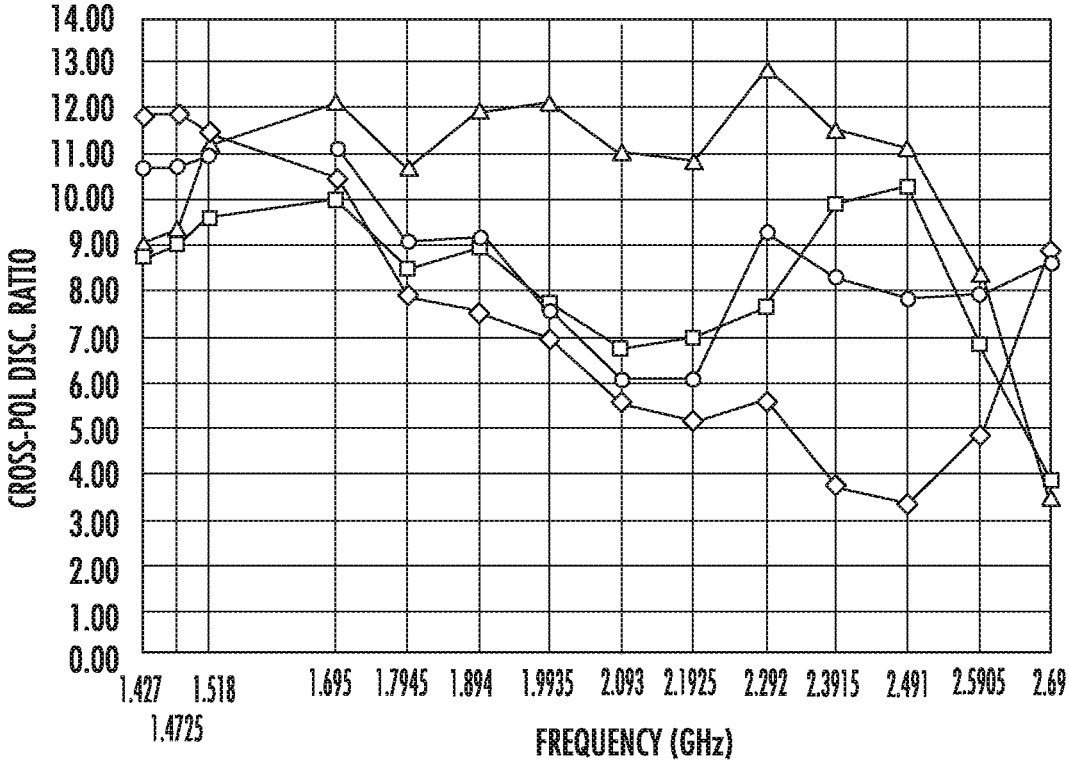

FIGS. 8A and 8B are graphs illustrating the cross-polarization discrimination ratio performance of a linear array of mid-band radiating elements according to embodiments of the present invention when implemented with balanced (FIG. 8A) and unbalanced dipole arms (FIG. 8B). The cross-polarization discrimination ratio is the ratio of the magnitude of the power at the desired polarization (the co-polarization) within the sector to the magnitude of the power at the orthogonal polarization (the cross-polarization) within the sector. Thus, the higher the value of the ratio the better. As shown in FIG. 8A, when the linear array is implemented using radiating elements according to embodiments of the present invention that include balanced dipole arms, the cross-polarization discrimination ratio performance is poor for polarization P1 at large electronic downtilts. When radiating elements having unbalanced dipole arms are used instead, there is a slight decrease in cross-polarization discrimination ratio performance at the low end of the frequency band, but an improvement of about 3 dB is achieved at the upper end of the frequency band.

Thus, it can be seen that the use of radiating elements having unbalanced dipole arms may improve the performance of the base station antennas according to embodiments of the present invention in some situations.

Figure 9A:
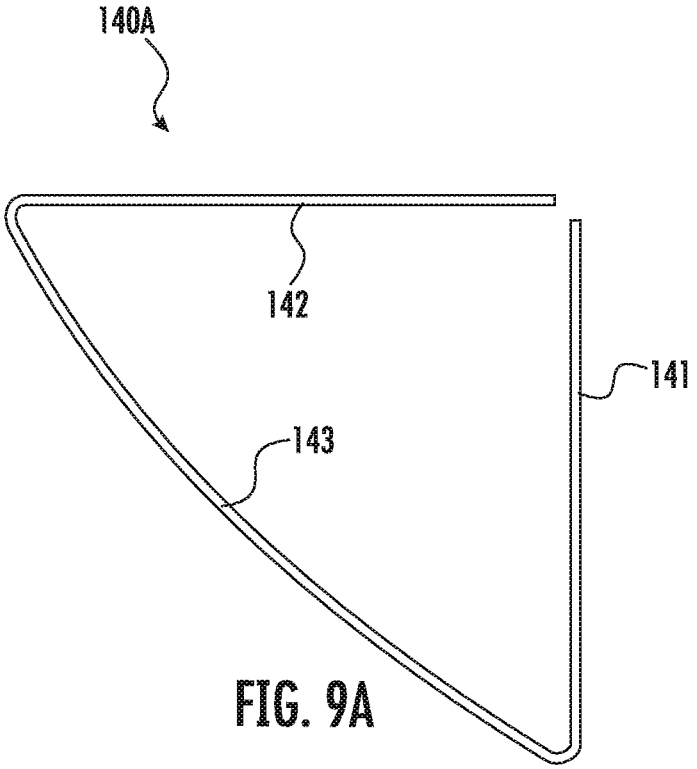
FIGS. 9A-9D schematically illustrate parasitic elements according to further embodiments of the present invention that may be used in place of the parasitic elements shown in FIG. 3A.
Figure 9B:
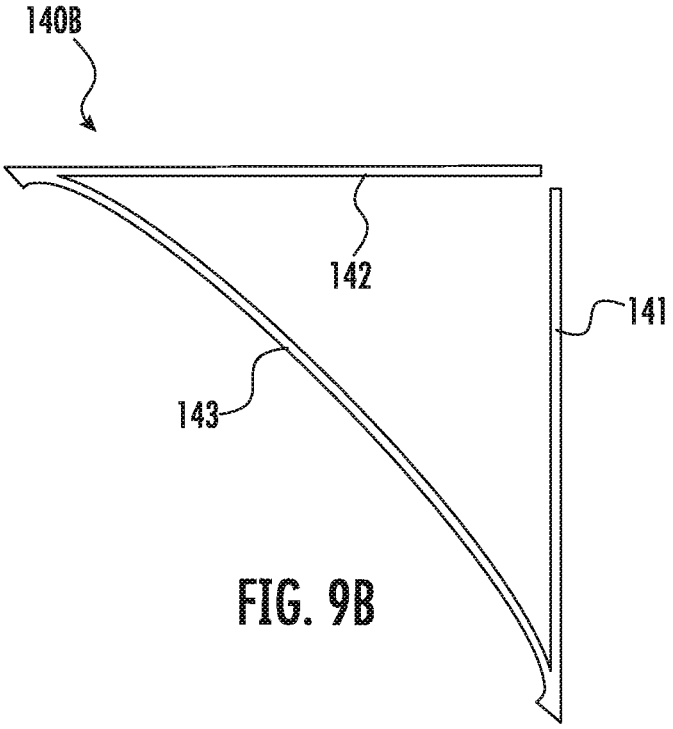
Figure 9C:
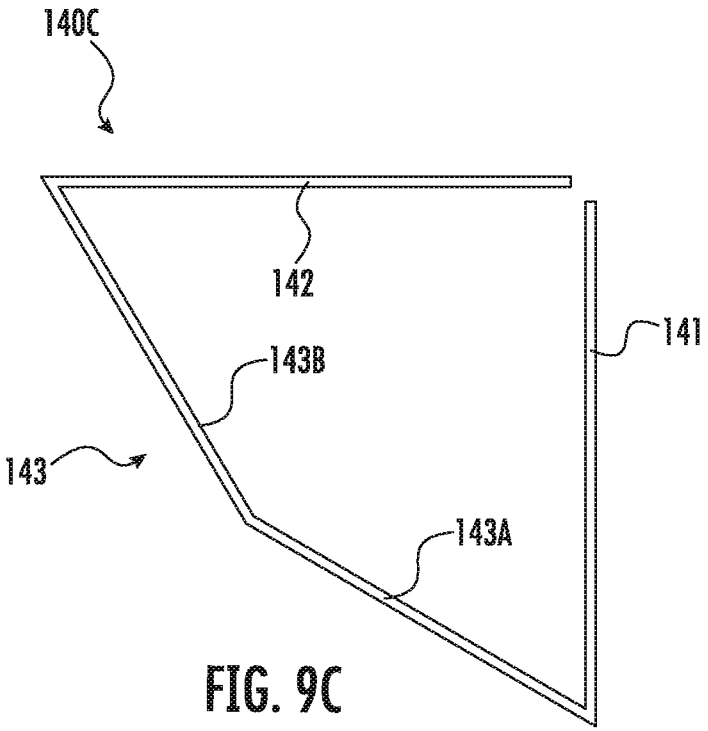
Figure 9D:
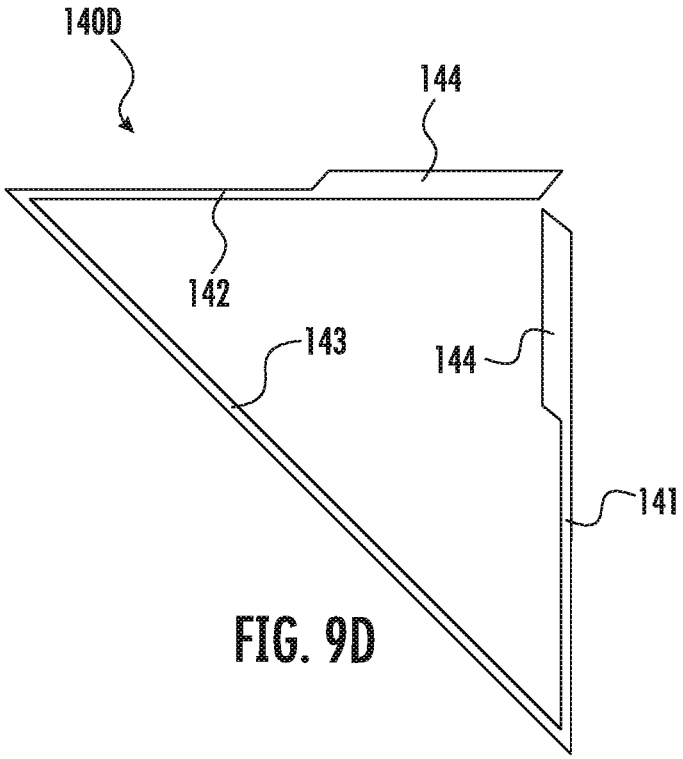
Figure 10:
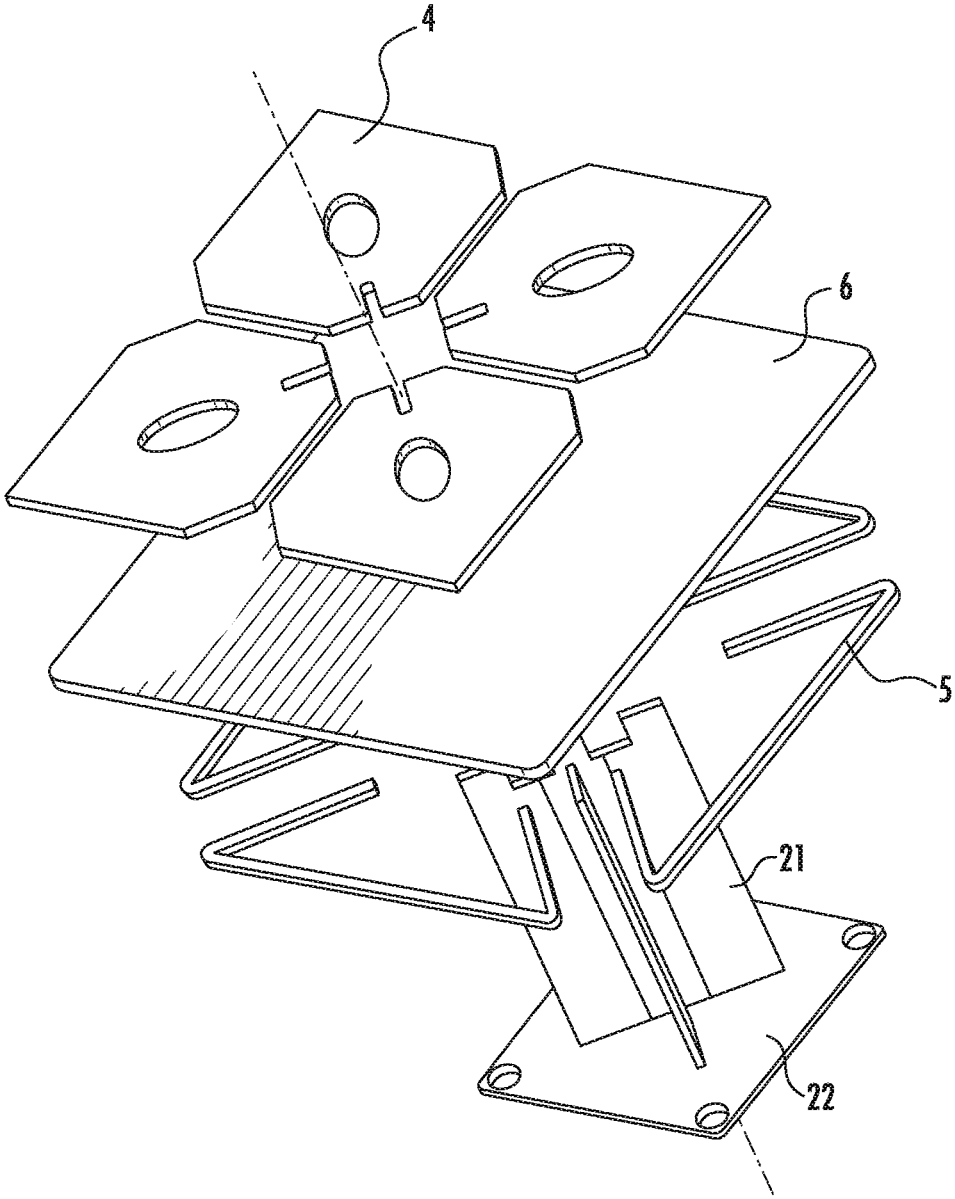
FIG. 10 (PRIOR ART)
FIG. 10 is an exploded perspective view of a conventional radiating element that includes a parasitic conductive element.

It will be appreciated that numerous changes may be made to the radiating element 100 depicted in FIG. 3 without departing from the scope of the present invention. As one example, parasitic elements 140 included in the radiating element 100 have three straight conductive segments 141-143 that each have a constant cross-sectional shape and area. In other embodiments, more than three conductive segments could be provided, curved or angled conductive segments could be used instead of one or more of the straight conductive segments, and/or the cross-sectional shape and/or area of the conductive segments could vary. For example, FIGS. 9A-9D schematically illustrate examples of alternative parasitic elements 140A-140D, respectively, that could be used in place of the parasitic elements 140 depicted in FIGS. 3A-3B. As shown in FIGS. 9A and 9B, one or more of the conductive segments 141, 142, 143 may have curved shapes or other non-linear shapes. While the dipole arms are not shown in FIG. 9A, it is apparent that due to the use of an outwardly curved conductive segment 143 the parasitic element 140A may extend outside the footprint of the dipole radiators of the radiating element. FIG. 9C illustrates a parasitic element 140C that includes more than three conductive segments by splitting conductive segment 143 into two non-linear sub-segments 143A, 143B. FIG. 9D illustrates how one or more of the conductive segments may have non-constant cross-sections. In particular, in the embodiment of FIG. 9D conductive segments 141 and 142 each include an enlarged section 144.

It will also be appreciated that the parasitic elements 140 may be mounted in different locations with respect to the dipole arms 130. For example, in another embodiment, the parasitic elements 140 could be mounted farther forwardly so that they couple with a central portion of the rearward extensions 134 of the dipole arms 130 as opposed to the rear portions of the extensions 134. In some embodiments, it may be beneficial to mount the parasitic elements 140 closer to the reflector 22 and farther away from the front surfaces 132 of the dipole arms 130 in order to reduce the effect of the parasitic elements 140 on the shape of the antenna pattern. However, it is also necessary to obtain sufficient coupling between the dipole arms 130 and the parasitic elements 140, which may limit how far rearwardly the parasitic elements 140 may be mounted with respect to the dipole arms 130.

While the discussion above primarily focuses on mid-band radiating elements that include parasitic elements that allow for operation across the entire 1.427-2.690 GHz frequency band, it will be appreciated that embodiments of the present invention are not limited thereto, and that the parasitic elements discussed herein may be used with radiating elements that operate in any cellular frequency band. It will likewise be appreciated that the dimensions of the various components of the parasitic elements may be varied from what is shown in the example embodiments described above.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A radiating element for a base station antenna, comprising a first dipole radiator that includes a first dipole arm that has a front surface and first and second extensions that project rearwardly from respective side edges of the front surface of the first dipole arm;

a second dipole radiator that includes a second dipole arm that has a front surface and first and second extensions that project rearwardly from respective side edges of the front surface of the second dipole arm; and a parasitic element having a first conductive segment that is configured to capacitively couple to the first extension of the first dipole arm, a second conductive segment that is configured to capacitively couple to the second extension of the second dipole arm, and a third conductive segment that electrically connects the first conductive segment to the second conductive segment, wherein the parasitic element fits within a physical footprint of the radiating element.

2. The radiating element of claim 1, wherein the first conductive segment is positioned adjacent a rear edge of the first extension of the first dipole arm, and the second conductive segment is positioned adjacent a rear edge of the second extension of the second dipole arm.

3. The radiating element of claim 1, wherein the first conductive segment, the second conductive segment and the third conductive segment of the parasitic element are all positioned between the first dipole arm and the second dipole arm.

4. The radiating element of claim 1, wherein the first dipole radiator further includes a third dipole arm that has a front surface and first and second extensions that project rearwardly from respective side edges of the front surface of the third dipole arm, and the second dipole radiator further includes a fourth dipole arm that has a front surface and first and second extensions that project rearwardly from respective side edges of the front surface of the fourth dipole arm.

5. The radiating element of claim 4, wherein the first dipole arm further includes a third extension that projects rearwardly from a distal end of the front surface of the first dipole arm, and wherein the fourth dipole arm further includes a third extension that projects rearwardly from a distal end of the front surface of the fourth dipole arm.

6. The radiating element of claim 4, wherein the first dipole arm further includes a third extension that projects rearwardly from a distal end of the front surface of the first dipole arm, and wherein the second dipole arm does not include an extension that projects rearwardly from a distal end of the front surface of the second dipole arm.

7. The radiating element of claim 1, wherein the parasitic element is configured so that when the first dipole arm is excited, current flows outwardly on the first dipole arm and current flows inwardly on the first conductive segment.

8. The radiating element of claim 1, wherein each of the first conductive segment, the second conductive segment and the third conductive segment of the parasitic element is an elongated element having a length, a width and a depth, where the length exceeds the width and the depth by at least a factor of ten.

9. The radiating element of claim 4, wherein the radiating element further comprises:

a second parasitic element having a first conductive segment that is configured to capacitively couple to the first extension of the second dipole arm, a second conductive segment that is configured to capacitively couple to the second extension of the third dipole arm, and a third conductive segment that electrically connects the first conductive segment of the second parasitic element to the second conductive segment of the second parasitic element;

a third parasitic element having a first conductive segment that is configured to capacitively couple to the first extension of the third dipole arm, a second conductive segment that is configured to capacitively couple to the second extension of the fourth dipole arm, and a third conductive segment that electrically connects the first conductive segment of the third parasitic element to the second conductive segment of the third parasitic element; and a fourth parasitic element having a first conductive segment that is configured to capacitively couple to the first extension of the fourth dipole arm, a second conductive segment that is configured to capacitively couple to the second extension of the first dipole arm, and a third conductive segment that electrically connects the first conductive segment of the fourth parasitic element to the second conductive segment of the fourth parasitic element.

10. A radiating element for a base station antenna, comprising a first dipole radiator that includes a first dipole arm that has a front surface and first and second extensions that project rearwardly from respective side edges of the front surface of the first dipole arm;

a second dipole radiator that includes a second dipole arm that has a front surface and first and second extensions that project rearwardly from respective side edges of the front surface of the second dipole arm; and a parasitic element having a first conductive segment that is configured to capacitively couple to the first extension of the first dipole arm, a second conductive segment that is configured to capacitively couple to the second extension of the second dipole arm, and a third conductive segment that electrically connects the first conductive segment to the second conductive segment, wherein a first end of the first conductive segment is adjacent a base of the first dipole arm and a second end of the first conductive segment is adjacent a distal end of the first dipole arm.

11. The radiating element of claim 10, wherein the parasitic element is completely positioned within a smallest square that fits around the first and second dipole radiators when the radiating element is viewed from the front.

12. The radiating element of claim 10, wherein the first conductive segment is positioned adjacent a rear edge of the first extension of the first dipole arm, and the second conductive segment is positioned adjacent a rear edge of the second extension of the second dipole arm.

13. The radiating element of claim 10, wherein the first dipole arm further includes a third extension that projects rearwardly from a distal end of the front surface of the first dipole arm, and wherein the second dipole arm does not include an extension that projects rearwardly from a distal end of the front surface of the second dipole arm.

14. The radiating element of claim 10, wherein the parasitic element is configured so that when the first dipole arm is excited, current flows outwardly on the first dipole arm and current flows inwardly on the first conductive segment.

15. The radiating element of claim 10, wherein the parasitic element is configured to increase a length of a current path for radio frequency ("RF") energy in a lower portion of an operating frequency band of the radiating element and to provide less of an increase in a current path for RF energy in an upper portion of the operating frequency band of the radiating element.

16. A new radiating element for a base station antenna, comprising a first dipole radiator that includes a first dipole arm that has a front surface and first and second extensions that project rearwardly from respective side edges of the front surface of the first dipole arm;

a second dipole radiator that includes a second dipole arm that has a front surface and first and second extensions that project rearwardly from respective side edges of the front surface of the second dipole arm; and a parasitic element having a first conductive segment that is configured to capacitively couple to the first extension of the first dipole arm, a second conductive segment that is configured to capacitively couple to the second extension of the second dipole arm, and a third conductive segment that electrically connects the first conductive segment to the second conductive segment, wherein the first and second dipole radiators and the parasitic element are configured so that a first percentage of radio frequency ("RF") energy in a lower portion of an operating frequency band of the radiating element passes from the first and second dipole radiators to the parasitic element, and a second percentage of RF energy in an upper portion of the operating frequency band of the radiating element passes from the first and second dipole radiators to the parasitic element, wherein the first percentage is greater than the second percentage, wherein the first conductive segment, the second conductive segment and the third conductive segment of the parasitic element are all positioned between the first dipole arm and the second dipole arm.

17. The radiating element of claim 16, wherein the parasitic element fits within a physical footprint of the first and second dipole radiators.

18. The radiating element of claim 16, wherein the first dipole arm further includes a third extension that projects rearwardly from a distal end of the front surface of the first dipole arm, and wherein the second dipole arm does not include an extension that projects rearwardly from a distal end of the front surface of the second dipole arm.

19. The radiating element of claim 16, wherein the parasitic element is configured so that when the first dipole arm is excited, current flows outwardly on the first dipole arm and current flows inwardly on the first conductive segment.

20. The radiating element of claim 16, wherein a first end of the first conductive segment is adjacent a base of the first dipole arm and a second end of the first conductive segment is adjacent a distal end of the first dipole arm.

21. A radiating element for a base station antenna, comprising a first dipole radiator that includes a first dipole arm that has a front surface and first and second extensions that project rearwardly from respective side edges of the front surface of the first dipole arm;

a second dipole radiator that includes a second dipole arm that has a front surface and first and second extensions that project rearwardly from respective side edges of the front surface of the second dipole arm; and a parasitic element having a first conductive segment that is configured to capacitively couple to the first extension of the first dipole arm, a second conductive segment that is configured to capacitively couple to the second extension of the second dipole arm, and a third conductive segment that electrically connects the first conductive segment to the second conductive segment, wherein the parasitic element is configured to increase a length of a current path for radio frequency ("RF") energy in a lower portion of an operating frequency band of the radiating element and to provide less of an increase in a current path for RF energy in an upper portion of the operating frequency band of the radiating element, wherein the first dipole arm further includes a third extension that projects rearwardly from a distal end of the front surface of the first dipole arm, and wherein the second dipole arm does not include an extension that projects rearwardly from a distal end of the front surface of the second dipole arm.

* * * * *